US006808383B1

(12) United States Patent
Kawakami et al.

(10) Patent No.: US 6,808,383 B1
(45) Date of Patent: Oct. 26, 2004

(54) DEVICE FOR FORMING VESSEL BODY

(75) Inventors: Kentaro Kawakami, Tokyo (JP); Takayuki Aigami, Saitama (JP)

(73) Assignee: Tozai Corporation Co., Ltd., Tokyo (JP)

( * ) Notice: Subject to any disclaimer, the term of this patent is extended or adjusted under 35 U.S.C. 154(b) by 0 days.

(21) Appl. No.: 09/557,176

(22) Filed: Apr. 21, 2000

(30) Foreign Application Priority Data

Apr. 11, 1999 (JP) ..... 11-349219

(51) Int. Cl.[7] ..... B29C 43/08
(52) U.S. Cl. ..... 425/418; 425/427; 425/459
(58) Field of Search ..... 425/418, 426, 425/427, 398, 459

(56) References Cited

U.S. PATENT DOCUMENTS 1,137,946 A * 5/1915 Baird ..... 425/418
2,218,804 A * 10/1940 Baird ..... 425/418
2,293,172 A * 8/1942 Ritter ..... 425/418
3,980,419 A * 9/1976 Franz ..... 425/459
4,286,938 A * 9/1981 Ryckman ..... 425/267
4,395,220 A * 7/1983 Harter ..... 429/427
5,658,603 A * 8/1997 Andersen et al. ..... 425/418

FOREIGN PATENT DOCUMENTS

GB 1 534 807 * 12/1978
JP 09-011209 * 1/1997

* cited by examiner

*Primary Examiner*—Robert Davis
*Assistant Examiner*—Thu Khanh T. Nguyen
(74) *Attorney, Agent, or Firm*—Armstrong, Kratz, Quintos, Hanson & Brooks, LLP

(57) ABSTRACT

A device, for forming a vessel body, which has an open top negative mold, a ring-like lid member for the negative mold with an inside diameter which is smaller than an open top diameter of the mold, a cylindrical rotary trowel which is mechanically fixed to move against an inner surface of the mold within a predetermined range and is at least longer in length than a height of an inner wall surface of the vessel body to be formed, and a trowel drive for rotating the rotary trowel.

7 Claims, 7 Drawing Sheets

DEVICE FOR FORMING VESSEL BODY

BACKGROUND OF THE INVENTION

1. Field of the Invention

The present invention relates to a method and device for mechanically forming a hollow vessel body and more particularly relates to an effective method and device for mechanically and automatically forming a hollow vessel even when a viscosity of a raw material thereof is considerably low, and a hollow vessel body thus formed.

2. Prior Art

Waste recycling has been considered as an important issue in order to save resources, preserve living surroundings and prevent environmental pollution. One of the most familiar and urgent issues is a reuse of waste paper such as news paper, magazine, etc.

Waste paper is typically reused as regenerated paper, while a paper regeneration process has various industrial problems caused by waste paper treatment to prepare the starting material, residues thereof, relatively high production cost, etc. It is therefore desirable to recycle waste paper as simply as possible without troublesome treatment and addition of additives.

A cost-saving recycle process of waste paper is, for example, to simply slurry paper in water, which is used to form a vessel body such as flowerpots or a block body such as brick. The thus water-slurried waste paper, however, is not useful at all as a starting material to form the above mentioned vessel body because of a poor viscosity although it might sometimes be used for production of paper brick and the like. One of important factors for producing the waste paper vessel body such as flowerpots that the vessel can be formed on a large scale at a low cost while quality thereof is not necessarily high-grade. It seems possible to use a conventional device comprising a jigger, a negative mold and a forming attachment provided with a trowel (hereinafter simply referred to as a jigger unit) for mass-production of waste paper flowerpots, etc. Such a waste paper material, however, can not be shaped into a vessel body by conventional jigger units because of an excessively low viscosity thereof.

When the waste paper material is applied to the surface of a negative mold by means of a trowel, the material is easily repelled from or hardly stuck on the mold so that no shape is formed thereon.

When a vessel body is formed by means of a conventional jigger unit an applicable material is a pottery clay which is freely and easily transformed and water content thereof has been adjusted to appropriate hardness (or softness) enough to keep a vessel shape to be formed. Thus, such a pottery clay can be formed by the conventional jiggler unit without trouble. Conversely, it might be said that the above mentioned jigger unit has been developed only for forming the pottery clay.

However, it is impossible to obtain quality similar to the pottery clay even if a water content of the waste paper material is carefully controlled when the material is prepared by simply slurrying waste paper in water. The slurried waste paper is hardly used as a starting material at a higher water content while it becomes rather dry and decreases a viscosity impracticably at a lower water content.

A slurry of waste paper is sometimes mixed with a solidifying agent or a glue to improve properties of the material, however, such a mixture is different from the environmentally desirable reuse of waste paper as it is and what is worse, the thus mixed material still shows a relatively low viscosity and keeps a rather dryish state.

Although waste paper may be chemically treated to yield a starting material which has similar properties as a pottery clay, the present invention intends to reuse waste paper as it is without adding any chemical agent.

A material of waste paper is conventionally formed by means of press molding. It is necessary to finely distribute the material on the mold surface due to poor flowability thereof, while water extracted therefrom should be released by means of, for example, a partially meshed mold. The product thus formed under such a complicated condition looks quite poor and, in addition, should be reinforced by wax finishing, etc.

According to the present invention, a method and a device for mechanically and automatically forming a vessel body even when a material has low viscosity such as waste paper of lower water content prepared by simply slurrying it in water, the thus formed product looking reasonably good and having sufficient strength, are provided.

SUMMARY OF THE INVENTION

It is an object of the present invention to provide a method for forming a vessel body in which a material is charged in a negative mold, pressed to and spread on a mold surface by means of a rotating cylindrical rotary trowel to form a vessel body.

Another object of the present invention is to provide a device for forming a vessel body which comprises an open top negative mold, a ring-like lid member of a negative mold, which inside diameter is smaller than an open top diameter of the mold, a cylindrical rotary trowel which is mechanically fixed to move against an inner surface of the mold within a predetermined range and is at least longer than height of an inner wall surface of the vessel body to be formed, and a trowel drive.

Yet another object of the present invention is to provide a vessel body formed by a method stated above in which there is used a material of extremely low viscosity such as that prepared by slurring waste paper in water.

DETAILED DESCRIPTION

Figure 1:
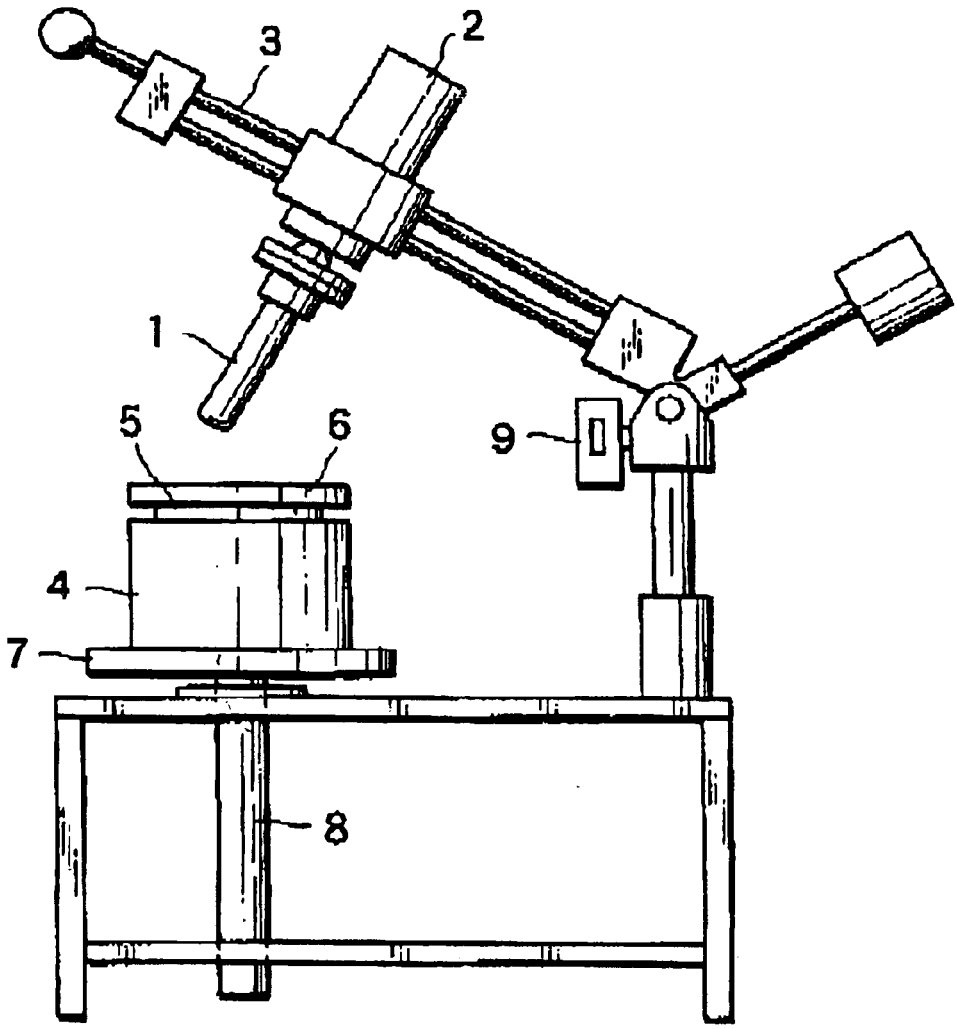
FIG. 1 is a schematic side view of a vessel body forming devise of the present invention.

The negative mold may be a rotatable type and be forcibly rotated in the same rotating direction of the rotary trowel at a surface rotational speed lower than that of the rotary trowel so as to form a vessel body.

When such a negative mold of rotatable type is used, the mold per se can be rotated by means of the rotary trowel, while formation of a vessel body is conducted successfully as a result of different rotation of the mold and the trowel. It is an important feature of the present invention that rotation of the negative mold is slower than that of the rotary trowel. The negative mold may also be forcible rotated by means of a drive such as a motor.

Further, the negative mold used in the present invention may be a split type. A ring-like lid member may be integrally formed on such a negative mold of split type. The ring-like lid member may be integrally formed either on each split half as a part thereof or on one of the split halves as a whole if the ring-like lid member is not split. The split type mold may be a rotatable type.

The negative mold may be combined with a shave stand for fitting the mold and a turn table for supporting the shave stand.

There may be used a drive which rotates the negative mold in the same rotating direction as the rotary trowel at a surface rotational speed lower than that of the trowel.

The rotary trowel may have a shape of a right cylinder or cone, while thickness thereof may be partially increased or decreased.

The rotary trowel may be moved in close to the inner surface of the negative mold at a certain space to give the thickness of a vessel body to be formed.

The rotary trowel is preferably rotated at high speed of, for example, 1,000 r.p.m. Although rotational speed less than 1,000 r.p.m. is also effective, it takes a long time to conduct a smooth forming process at relatively low speed.

The negative mold may be fixed directly to a support such as a rotatable shaft in an undetachable or detachable situation. As the negative mold should be changed depending on a type or kind of vessel bodies to be formed, the mold is replaced together with the above mentioned support, shave stand and/or turntable unless otherwise the mold is fixed undetachably.

A combination of each negative mold, shave stand and turn table is necessarily fixed rotatably around the axial center while drive for the shave stand is not necessary in general because the shave stand is forcibly rotated through a forming material with the force of the rotary trowel during the forming process. When a large vessel body is formed, however, a torque of the rotary trowel is not enough to rotate the shave stand and the negative mold with a large amount of material. A drive may be used in such a case to rotate a combination of the negative mold, shave stand and turn table.

The negative mold may be made of plastics, metal and the like, rigidity thereof being preferably high.

A relative arrangement of the negative mold and the shave stand and/or the turn table may be similar to that of conventional jiggers.

A mold lid may be detachably fitted to the negative mold by conventional means such as screws. The mold lid is formed as a ring-like disc by cutting off around the central part thereof and protruded inward like a flange on the negative mold, protruded width thereof corresponding to thickness of the top surface of the vessel body. The lid is put on the mold during the forming process and taken off when the formed vessel body is taken out therefrom. In the case of a particular mold type, such as a negative mold separable into two parts for easier ejection of the product, the lid may be fixed to the mold undetachably.

The method or device of the present invention is most effectively used to form materials of extremely low viscosity, and is also usefully applicable to conventional materials such as porcelain clay as a matter of course.

The material used in the present method or device is prepared by simply slurring waste paper in water.

Further, it is quite easy for the present invention to form a multilayered vessel body by using a mixture of different materials.

Materials of extremely low viscosity which can be used to form a vessel body by the present invention include not only waste paper itself but a mixture of waste paper and one of more materials selected from powdery or particulate charcoal, solid fertilizer, enzyme containing particles and mineral such as cullet. Using the above mentioned mixture, a desirable vessel body can be formed by the present invention.

Charcoal particles, wood chips and leaf mold may be used as a material of the present vessel body independently or in the form of mixture thereof.

Further it is possible to use waste wire coil as a useful material of the present invention, which is prepared by removing thermoplastic cover such as polyvinyl chloride therefrom, finely cutting wire and coil paper to form particle and slurring with water.

A multi-layer vessel body is easily formed by the present invention by using a mixture of different materials.

A vessel body formed by the present invention includes products such as a flower pot, trash box, etc., but is not limited to a specific product.

According to the present invention, any of the above mentioned material can be used to form a uniform vessel body of high quality without skilled technique.

The present device may be built in an on-line mass production system.

The thus formed vessel body of waste paper alone or a mixture thereof exhibits excellent appearance and strength which has never been achieved by similar products.

According to the present invention, it is not necessary to add any glue or adhesive to the material nor to reinforce the product by waxing, etc.

As has been described above, the present invention provides quite a novel and excellent method and device for forming a vessel body, while there may be used some unexpected materials other than those materials as disclosed herein.

The material is kept between the rotary trowel and the inner surface of the negative mold, and pressed to and extended along the surface by means of the trowel which rotates faster than the negative mold.

Because of characteristic features of the present invention as described above, even a material of extremely low viscosity can be formed mechanically and automatically as a vessel body. It is possible to easily produce uniform vessel bodies of high quality without any skilled technique.

The vessel bodies produced by the present invention are far more excellent in appearance and shape than those of conventional products. In addition, they are strong enough to leave out any reinforcing process such as waxing.

EMBODIMENTS

Referring now to the attached drawings, the present invention will be detailed in the following.

EXAMPLE 1

Figure 2:
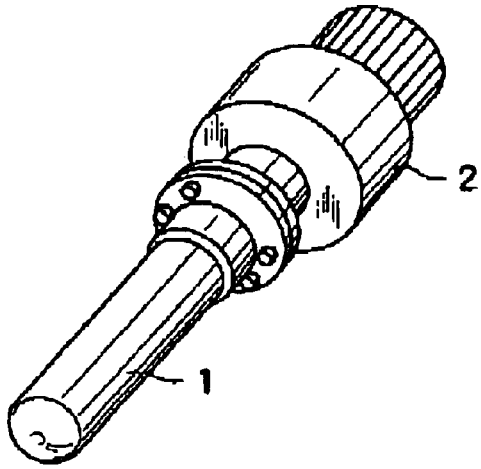
FIG. 2 is a perspective view of a rotary trowel and a driving motor used in a vessel body forming devise of the present invention.
Figure 3:
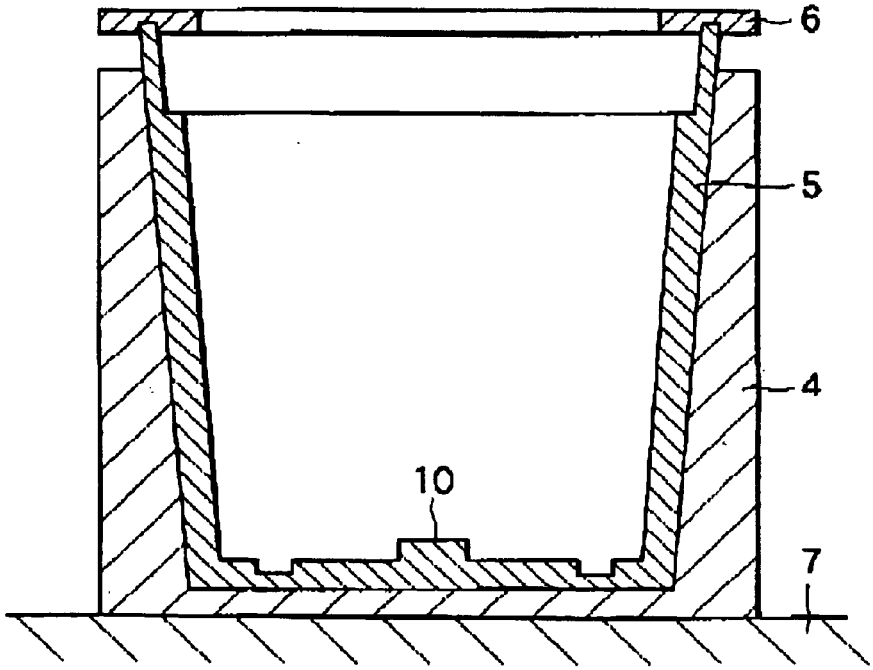
FIG. 3 is a perspective view of a rotary trowel and a driving motor used in another vessel body forming devise of the present invention.
Figure 4:
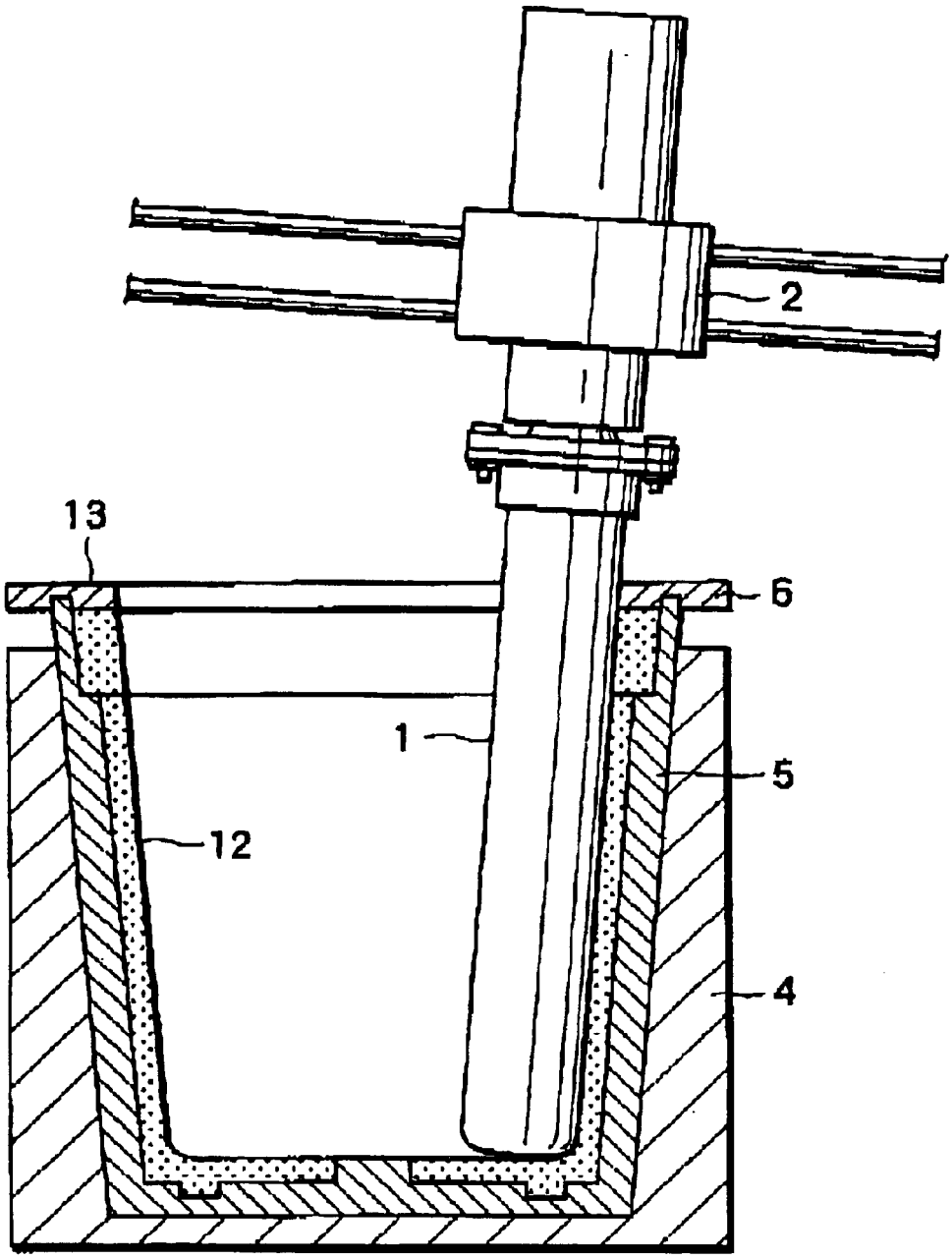
FIG. 4 is a vertical center-section of a vessel body forming devise of the present invention provided with a shave stand, a negative mold and a lid.
Figure 5:
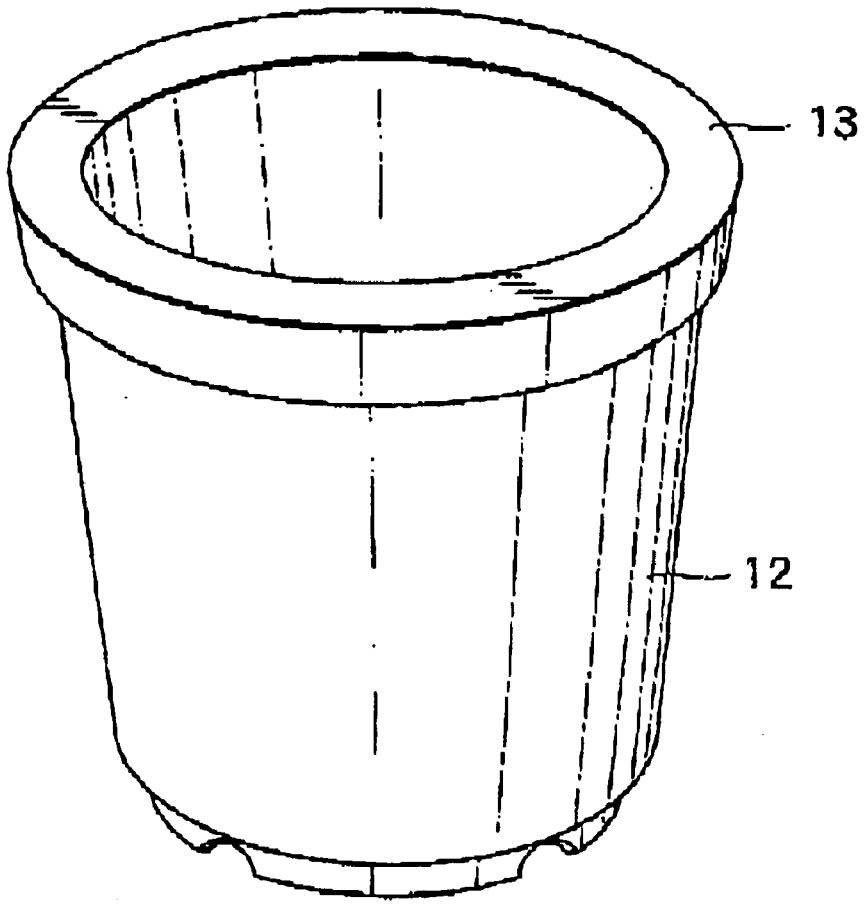
FIG. 5 is an enlarged vertical center-section of a vessel body forming devise of the present invention provided with a shave stand, negative mold, a lid and a rotary trowel when a material is formed.

FIG. 1 is a schematic side view of the vessel body forming device. FIG. 2 is a perspective view of a rotary trowel and a driving motor. FIG. 3 is a vertical sectional view of the vessel body forming device provided with a shave stand, a negative mold and a lid, FIG. 4 is an enlarged vertical sectional view of the vessel body forming device provided with a shave stand, negative mold, a lid and a rotary trowel when a material is formed, and FIG. 5 is a perspective view of a flower pot formed by the present invention. In FIG. 1, 1, 2 and 3 designate a rotary trowel, a drive motor and a manipulating arm, respectively, and 4 designates a shave stand. 5 and 6 designate a negative mold and a ring-like lid portion, respectively. And further, 7 and 8 designate a turn table and a shaft, respectively.

The shave stand is additionally used together with the turn table in this example.

The rotary trowel 1 is a stainless steel right cylinder of 3 cm in diameter and chamfered to form a moderate and spherical tip. The rotary trowel 1 is co-axially attached to a shaft of the drive motor 2, and turned around and stopped when the drive motor 2 is turned on and off. An on-off switch 9 of the motor 2 is fixed on a joint portion of the arm 3 so as to switch on when a supporting portion of the arm moves downward to a predetermined position, i.e., the position just before a point where the rotary trowel 1 begins to form a material on the negative mold.

The rotary trowel 1 is conventionally fixed to the arm by a pair of screws and nuts while the arm is adjusted to move within a predetermined range so that the rotary trowel 1 does not move downward over the above mentioned position in the shave stand 4 and also keeps a certain space to the inner surface of the negative mold.

The negative mold has a hollow portion on the center of the bottom where a protrusion 10 of the shave stand 4 is fitted to form a draining hole of flower pot to be prepared. The protrusion 10 of the shave stand shoots upward from the bottom surface of the mold to an extent equal to thickness of the bottom of the flower pot.

The negative mold 5 is made of plastics and not necessarily water absorbable. A gypsum negative mold used for a jigger tends to absorb too much water from the material to form a vessel body of the present invention and is not preferable from a standpoint of strength because the material is strongly pressed thereto by means of the rotary trowel.

The negative mold is detachably fitted to the shave stand 4 as a matter of course.

The ring-like lid 6 protrudes inward as a flange having width equal to top thickness of the flower pot and is fitted detachably on the negative mold by means of conventional screws.

The shave stand 4 is arranged co-axially and detachably on the turn table 7 which is rotatably fixed on a the shafts 8. As the turn table 7 functions as a flywheel, it is preferable to turn around the table 7 by hand before it is rotated by force of the rotary trowel. It is also preferable to use a drive unit to rotate the turn table at lower surface velocity of the mold 5 than that of the rotary trowel when a large vessel body is formed.

It is convenient to use a stop means to kill rotation soon after the forming process finishes. When such a stop means is not used, the turntable may be stopped by holding a periphery thereof by hand or allowed to turn around until it stops naturally.

EXAMPLE 2

Figure 7:
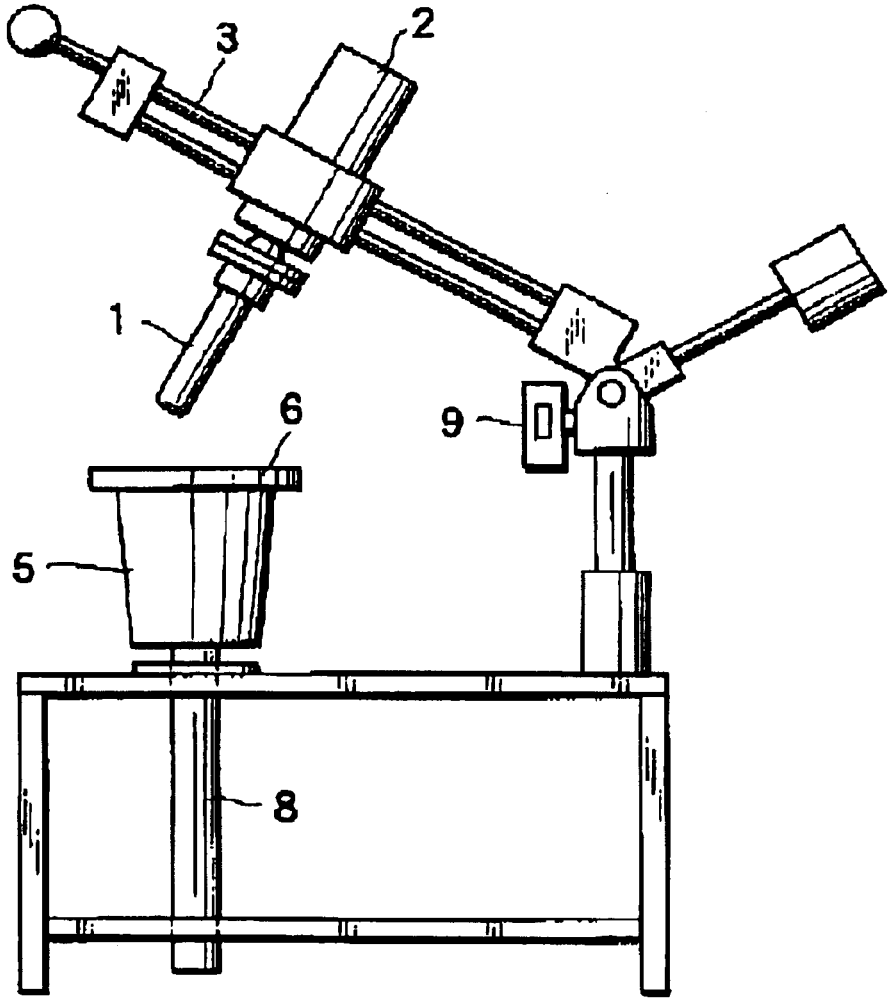
FIG. 7 is a vertical sectional view of a double-layered flower pot formed by the present invention.

FIG. 7 shows a forming device of the present invention in which the shave stand and the turn table used in Example 1 are removed. The forming process is conducted by this device basically in a similar manner as described in Example 1. A rotary trowel may also be the same as used in Example 1.

EXAMPLE 3

Using the forming device described in Example 1, a flower pot as shown in FIG. 5 was prepared.

The negative mold 5 was fitted to the shave stand 4 followed by putting the lid 6 thereon.

A forming material 11 was prepared by finely cutting 10 kg of news paper by means of a shredder, soaking the bulk of cut paper in 30 litter, of water, stirring the paper-water mixture by means of a stirrer to completely dissolve paper in water and wringing water from the mixture to yield about 33 kg of slurried paper (water content thereof being about 70%)

The thus prepared material 11 in an amount of about 500 g was charged in the negative mold 5 and subjected to the next step by controlling the arm 3 to move the rotary trowel 1 downward into the mold 5 so that the material 11 is pressed to the mold surface. The switch 9 was turned on by the jointing portion of the arm 3 during a downward movement thereof to automatically rotate the trowel 1 in the mold 5.

The turn table 7 was slowly turned around by hand before the forming process was started. Then, the shave stand 4 and the negative mold 5 began to rotate by force of the rotary trowel 1 together with the turn table 7. The material 11 was extended with the aid of rotation of the trowel 1 and that of the mold 5 to finally form the flower pot 12 between the trowel 1 and the surface of the mold 5 under the lid 6.

The thus extended material was raised from the bottom along the mold surface. The following process was continued by pressing and extending the material by means of the rotary trowel until the material reached the ring-like lid 6 as a flange, thereby the top surface of the flower pot being formed.

Overflowing of the material from the lid 6 was not observed because an amount required to form the flower pot was determined in advance and, at the same time, the process was carefully conducted to prevent such overflowing by controlling the rotary trowel. It should be noted, however, that the material in relatively larger or smaller amount in certain extent does not cause overflowing nor affect the forming process but yields a vessel body of relatively higher or lower density.

When the material 11 was pressed by the rotary trowel 1, water was wrung therefrom but immediately absorbed in the surrounding material, which did not affect the forming process because only a part of the material was pressed just for a moment to result in a slight amount of water.

The wet flower pot thus prepared and shown in FIG. 5 was exposed under the sun for two days to completely dry and harden. The thus prepared flower pot was practically useful and was not deformed nor damaged by repeated watering.

The flower pot exhibited sufficiently high density and excellent appearance of inner and outer surfaces thereof compared with that of a conventional product made mainly of waste paper. The flower pot was so strong that no additional reinforcement such as waxing was necessary.

Each vessel body formed by the present invention may be dried naturally or by means of a conventional dryer although a drying manner is different depending on a specific material to be formed.

EXAMPLE 4

Figure 6:
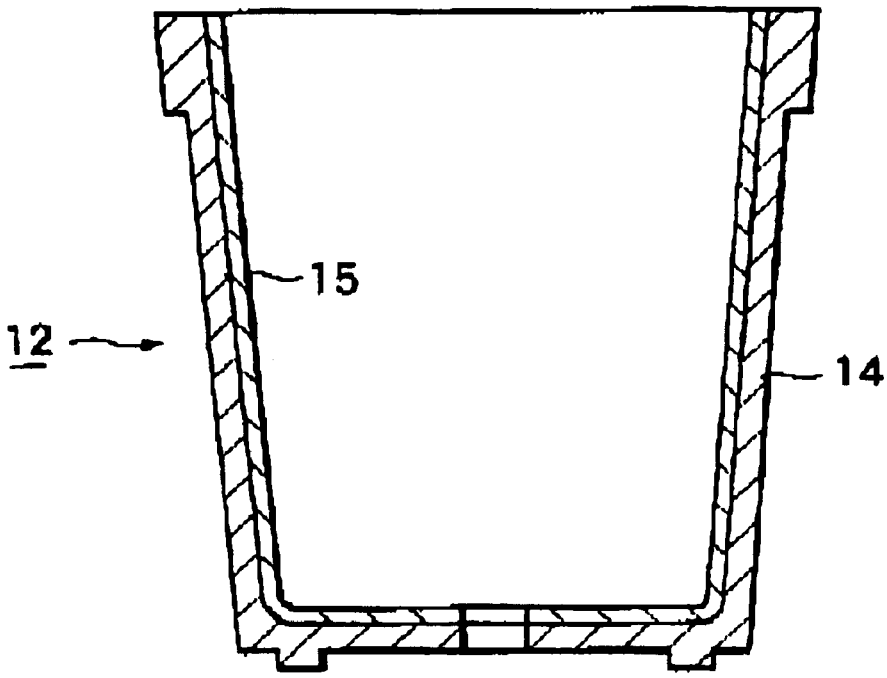
FIG. 6 is a perspective view of a flower pot formed by the present invention.

Using the same device and material of the Example 3, a thinner flower pot as an outer layer 14 was prepared. The outer layer was dried and again put in the negative mold while the material was homogeneously mixed with about 3 parts by volume of charcoal particles of at most 5 mm in diameter, which was applied to the inner surface of the dried one as an inner layer 15 to form a double-layered flower pot as shown in FIG. 6.

A flower pot comprising a mono-layer of charcoal mixed material has a coarse outer surface where charcoal particles are exposed, which tends to come off and soil a user's hands. On the other hand, the double-layered product formed by the present invention has no such defect and keeps a useful effect of the charcoal mixture for a long time.

It is important for preparing a multi-layered vessel body to form layers in the outer-to-inner order, that is, the outermost layer is formed at first and dried, then the second one is formed and dried and such a process may be repeated. For example, the outer layer is completed and then the second layer of the charcoal mixture is formed followed by drying the double-layered product as a whole, as described above. If the second layer is formed before the first layer is not dried charcoal particles are allowed to invade into the first layer during the forming process and are finally cropped out of the outer surface, which is inconvenient similar to the mono-layer product of charcoal mixture.

EXAMPLE 5

Figure 8:
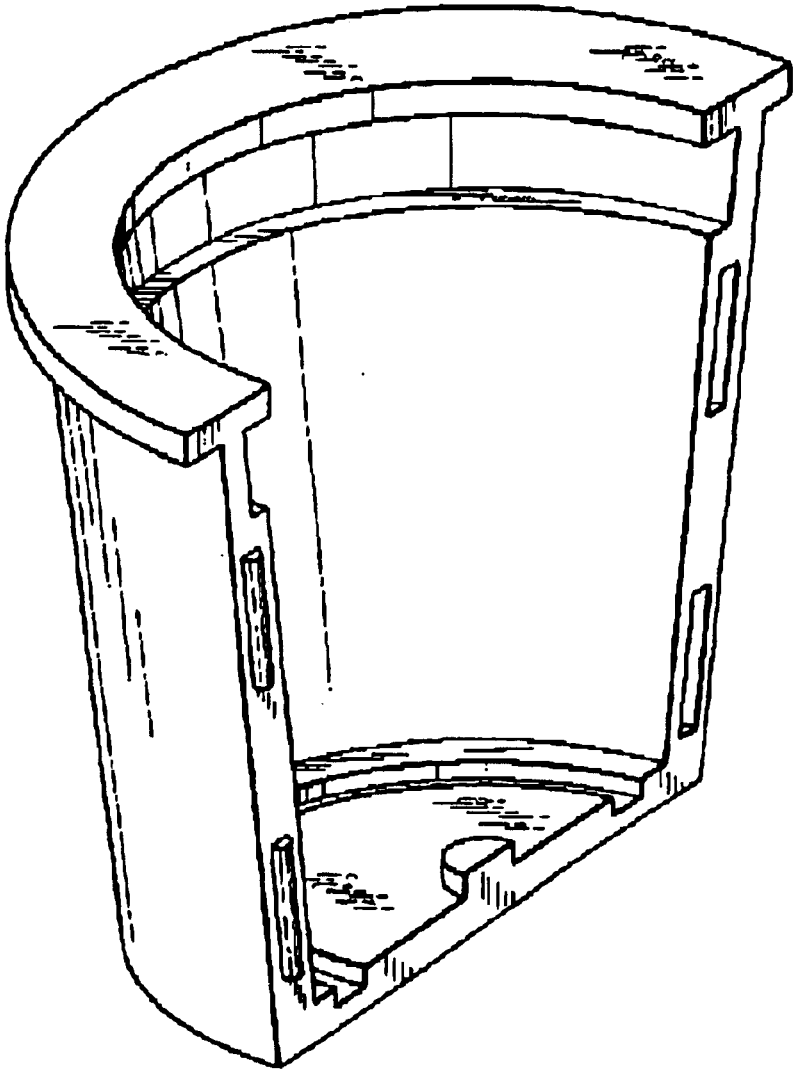
FIG. 8 is a perspective view of a half of split type negative mold.

A half of a negative mold is shown in FIG. 8, which structure is quite different from that used in the above Examples. This split type mold consists of two completely symmetrical halves thereof to be combined into one and is supported by a shave stand (not shown). Using the split type mold, a vessel body is formed similarly as described above. After the forming process is completed, the negative mold is removed from the shaving stand and split into two to take out a vessel body.

What is claimed is:

1. A device for forming a vessel body from a molding material which comprises an open top negative mold, a ring-shaped lid member for the negative mold with an inside diameter which is smaller than an open top diameter of the negative mold, a rotary trowel, having cylindrically shaped working surface, which is mechanically fixed to move against an inner surface of the negative mold within a predetermined range to press and spread the molding material on said inner surface of the negative mold and is at least longer than a height of an inner wall surface of the vessel body to be formed, and a rotary trowel drive.

2. A device for forming a vessel body which comprises an open top negative mold, a ring-shaped lid member for the negative mold with an inside diameter which is smaller than an open top diameter of the negative mold, a rotary trowel, having cylindrically shaped working surfaces, which is mechanically fixed to move against an inner surface of the negative mold within a predetermined range and is at least longer than a height of an inner wall surface of the vessel body to be formed, and a rotary trowel drive, wherein the negative mold is a is a split type.

3. A device claimed in claim 2 in which the ring-shaped lid member for the negative mold is integrally fixed to at least one split half of the split type negative mold.

4. A device for forming a vessel body which comprises an open top negative mold, a ring-shaped lid member for the negative mold with an inside diameter which is smaller-than an open top diameter of the negative mold, a rotary trowel, having cylindrically shaped working surfaces, which is mechanically fixed to move against an inner surface of the negative mold within a predetermined range and is at least longer than a height of an inner wall surface of the vessel body to be formed, and a rotary trowel drive, wherein the negative mold is a rotatable type and the negative mold is rotated about a central axis of the negative mold.

5. A device claimed in claim 1 which further comprises a shave stand for fitting the negative mold.

6. A device for forming a vessel body which comprises an open top negative mold, a ring-shaped lid member for the negative mold with an inside diameter which is smaller than an open top diameter of the negative mold, a rotary trowel, having cylindrically shaped working surfaces, which is mechanically fixed to move against an inner surface of the negative mold within a predetermined range and is at least longer than a height of an inner wall surface of the vessel body to be formed, a rotary trowel drive, and a turn table, rotatable about a central axis of the negative mold, for supporting the negative mold or a shave stand.

7. A device for forming a vessel body which comprises an open top negative mold, a ring-shaped lid member for the negative mold with an inside diameter which is smaller than an open top diameter of the negative mold, a rotary trowel, having cylindrically shaped working surfaces, which is mechanically fixed to move against an inner surface of the negative mold within a predetermined range and is at least longer than a height of an inner wall surface of the vessel body to be formed, and a rotary trowel drive, and a drive means for rotating the negative mold in the same rotating direction as the rotary trowel at a surface rotational speed lower than that of the rotary trowel.

* * * * *